US009039506B1

(12) United States Patent
Schmitt

(10) Patent No.: US 9,039,506 B1
(45) Date of Patent: May 26, 2015

(54) COMPETITIVE SOLITAIRE GAME

(71) Applicant: Joseph J. Schmitt, Spring Hill, FL (US)

(72) Inventor: Joseph J. Schmitt, Spring Hill, FL (US)

( * ) Notice: Subject to any disclaimer, the term of this patent is extended or adjusted under 35 U.S.C. 154(b) by 0 days.

(21) Appl. No.: 14/170,256

(22) Filed: Jan. 31, 2014

(51) Int. Cl.
*G07F 17/32* (2006.01)
*A63F 1/00* (2006.01)

(52) U.S. Cl.
CPC ..... *G07F 17/3293* (2013.01); *A63F 1/00* (2013.01)

(58) Field of Classification Search
CPC ..... G07F 17/3293
See application file for complete search history.

(56) References Cited

U.S. PATENT DOCUMENTS

| | | | |
|---|---|---|---|
| 5,531,440 | A | 7/1996 | Dabrowski et al. |
| 5,752,702 | A | 5/1998 | McDoniel |
| 5,951,012 | A | 9/1999 | Feola |
| 6,132,311 | A | 10/2000 | Williams |
| 6,227,969 | B1 | 5/2001 | Yoseloff |
| 9,299,170 | | 10/2001 | Yoseloff |
| 6,358,144 | B1 | 3/2002 | Kadlic et al. |
| 6,416,407 | B1 | 7/2002 | Carrico et al. |
| 6,425,506 | B1 | 7/2002 | Wu |
| 6,435,506 | B1 | 8/2002 | Piccoli |
| 6,443,456 | B1 | 9/2002 | Gajor |
| 6,454,266 | B1 | 9/2002 | Breeding et al. |
| 6,575,464 | B1 | 6/2003 | Fertitta et al. |
| 6,575,467 | B1 | 6/2003 | Kal |
| 6,604,998 | B1 | 8/2003 | Singer et al. |
| 6,893,049 | B1 | 5/2005 | Schmitt |
| 2002/0027322 | A1 | 3/2002 | Breeding et al. |
| 2003/0075869 | A1 | 4/2003 | Breeding et al. |

*Primary Examiner* — Seng H Lim
(74) *Attorney, Agent, or Firm* — Kenneth L. Green; Averill & Green

(57) ABSTRACT

A competitive solitaire game is played using a crazy-stud poker deck and scoring, and allows an inexperienced player an opportunity to win. Each hand begins by dealing pairs of cards into three columns, one face up, and one face down, for the house, and pairs of face up into three columns for the player. The player selects a column to discard from both hands. Next, a pair is added to each column, one face up, and one face down, for the house, and a pair to each column, face up, for the player. The player again selects a pair to discard from both hands. Finally, a pair is dealt to the house and to the player, face up, and the remaining six cards in each hand are scored. To win, the player must win a number N hands before the house wins a number M hands.

14 Claims, 1 Drawing Sheet

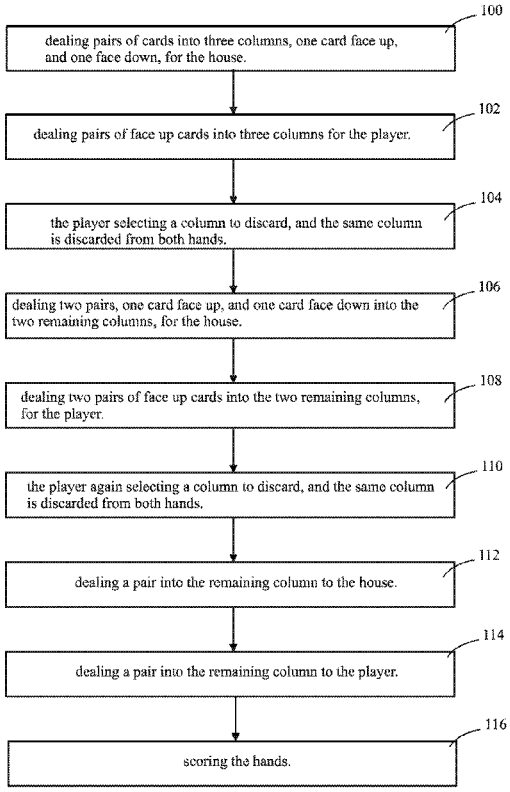

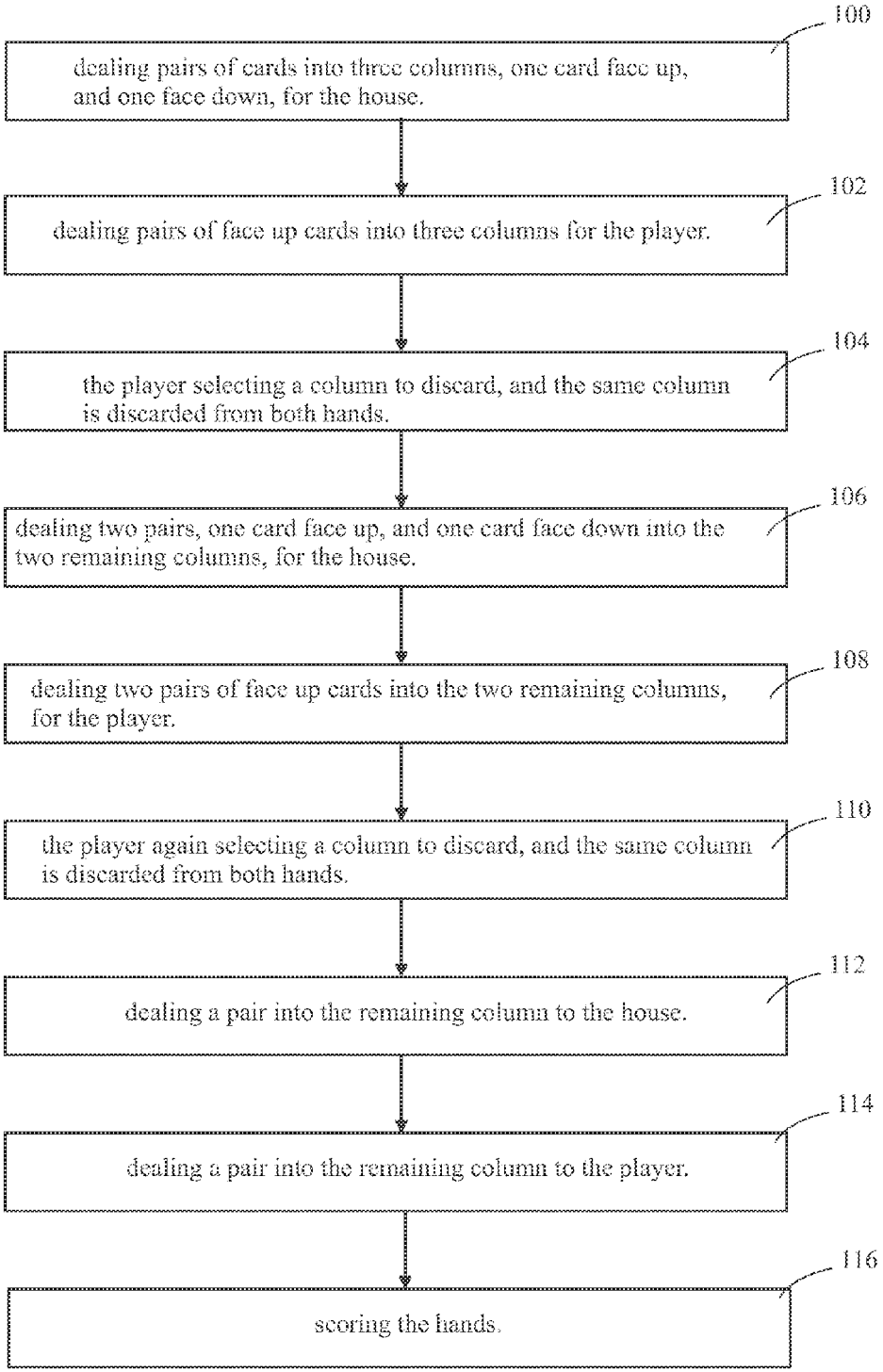
100
dealing pairs of cards into three columns, one card face up, and one face down, for the house.
102
dealing pairs of face up cards into three columns for the player.
104
the player selecting a column to discard, and the same column is discarded from both hands.
106
dealing two pairs, one card face up, and one card face down into the two remaining columns, for the house.
108
dealing two pairs of face up cards into the two remaining columns, for the player.
110
the player again selecting a column to discard, and the same column is discarded from both hands.
112
dealing a pair into the remaining column to the house.
114
dealing a pair into the remaining column to the player.
116
scoring the hands.

COMPETITIVE SOLITAIRE GAME

BACKGROUND OF THE INVENTION

The present invention relates to card games and in particular to a solitary card game using a crazy-stud poker card deck.

A crazy-stud poker game is discloses in U.S. Pat. No. 6,893,049 filed by the present applicant. The game uses a unique crazy-stud poker deck which provides an explosive gaming experience and provides an inexperienced player with an opportunity to beat a more experienced, player.

Individuals often amuse themselves by playing card games, but in some instances, there are no opponents available to play against. The well known game of solitary was created to allow such individuals to play against an unknown house. Unfortunately, many players have become bored with solitary because of the lack of competition.

Further, modern gambling is often played on a video machine which generates results based on random numbers. Such games are very common, and players may become bored playing the same game, especially when the player's role is reduced to pushing a single button to execute a new round of play. While games may be introduced simulating, for example, 21, many players are inexperienced and have almost no chance of beating even a fair machine. Thus a need exists for a solitary game which allows player interaction and provides a reasonable opportunity for the play to win.

BRIEF SUMMARY OF THE INVENTION

The present invention addresses the above and other needs by providing a solitary card game which may be played with a deck of cards or on a machine. The game uses a crazy-stud poker deck and scoring, and allows an even inexperienced player an opportunity to win. Each hand begins by dealing three pairs of cards, one card face up, and one card face down, for the house, and three pairs of face up cards for the player. The player selects a pair of cards to discard from their hand, and discards the corresponding column pair of cards from the house hand. Next, two pairs are dealt, one card face up, and one card face down, for the house, and two pairs of face up cards for the player. The player again selects one column pair of cards to discard from both hands. Finally a final pair is dealt to the house and to the player, face up, and the remaining six cards in each hand are scored. To win, the player must win a number N hands before the house wins a number M hands. The numbers N and M may be selected by the player based on the player's experience to provide a challenging game, and generally, N is greater than M.

In accordance with one aspect of the invention, there is provided solitary card game using a crazy-stud poker deck of 52 playing cards. The deck includes eight cards with the extra value card phrases preferably printed on said cards, examples of said phrases being: ANY BLACK CARD on the aces of spades and clubs, ANY RED CARD on aces of diamonds and hearts, and FILLS ANY TWO PAIR on deuces of clubs, spades, diamonds and hearts, While such printing is preferred, any clear designation of a cards unique quality may be used.

In accordance with another aspect of the invention, there is provided solitary card game using a crazy-stud poker deck of 52 playing cards. An ace of hearts or diamonds may be played as any red card and an ace of clubs or spades may be played as any black card. Any duce cards may be played to fill any two pair.

In accordance with still another aspect of the invention, there is provided solitary card game allowing a player to play offensively by selecting the strongest player cards to retain or defensively by selecting the weakest house cards to retain.

In accordance with yet another aspect of the invention, there is provided solitary card game providing an advantage to the player of allowing the player to select which cards to discard. Because the player has the advantage, the game may require that the player win a number N hands before the house wins a smaller number M hands to win a game. For example, the game may require that the player win five hands before the house wins three or four hands to win a game, or that the player win four hands before the house wins two or three hands to win a game.

In accordance with another aspect of the invention, there is provided solitary card game having an electronic embodiment allowing a player to select a skill-level. In a hand held game device the player may select a skill-level to provide a challenging game to the player.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 1 describes a method for playing a competitive solitaire game according to the present invention.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

A method for playing a competitive solitaire game is shown in FIG. 1. The method includes dealing pairs of cards from a deck into three columns, one card face up, and one face down, for the house at step 100, dealing pairs of face up cards into three columns for the player at step 102, the player selecting a column to discard, and the same column is discarded from both hands at step 104, dealing two pairs, one card face up, and one card face down into the two remaining columns, for the house at step 106, dealing two pairs of face up cards into the two remaining columns, for the player at step 108, the player again selecting a column to discard, and the same column is discarded from both hands at step 110, dealing a pair into the remaining column to the house at step 112, dealing a pair into the remaining column to the player at step 114, and scoring the hands at 166.

Because the player selects which cards to discard, the player has an advantage over the house. The advantage varies based on the experience of the player, and to provide a challenging game, the game may require that the player win a number N hands before the house wins a smaller number M hands to win a game. For example, the game may require that an experienced player win five hands before the house wins three to win a game, or that an average player win five hands before the house wins four hands to win a game, or that an inexperienced player win four hands before the house wins three hands to win a game. Preferably, the player may select N and M at the start of a game.

For example, in a hand held game to win a game, an amateur player may be required to win five hands before the house wins six hands, an average player may be required to win five hands before the house wins five hands, a good player may be required to win five hands before the house wins four hands, a very good player may be required to win four hands before the house wins three hands, and the best players may be required to win three hands before the house wins two hands. The hand held game may allow the player to select the skill-level the player is playing at.

During play, the player may select to play offensively by discarding the column which is weakest in his own hand, or play defensively by discarding the column strongest in the house hand, or a combination of the player's strongest and house's weakest column.

A preferred deck is a 52 playing card poker deck sold under the trademark CRAZY-STUD POKER. The deck includes eight cards with the extra value card phrases preferably printed on said cards, examples of said phrases being: ANY BLACK CARD on the aces of spades and clubs, ANY RED CARD on aces of diamonds and hearts, and FILLS ANY TWO PAIR on deuces of clubs, spades, diamonds and hearts, While such printing is preferred, any clear designation of a cards unique quality may be used.

The competitive solitaire game may be played with a physical deck of cards, or on a video gambling machine.

While the invention herein disclosed has been described by means of specific embodiments and applications thereof, numerous modifications and variations could be made thereto by those skilled in the art without departing from the scope of the invention set forth in the claims.

I claim:

1. A competitive solitaire game comprising the steps of:

providing a gaming computer including:

a processor and memory storing software;

providing a display electrically connected to the computer;

the gaming computer running the software to simulate dealing pairs of cards from a deck into a house hand comprising three columns, one card face up, and one face down, for the house;

the display displaying the house hand;

the gaming computer running the software to simulate dealing pairs of face up cards into a player hand comprising three columns for the player;

the display displaying the player hand;

the player selecting a column to discard from the player hand and the house hand on the gaming computer;

the gaming computer running the software to simulate discarding the same first column from the player hand and the house hand;

the display displaying the player hand and the house hand after discarding the same first column from both hands;

the gaming computer running the software to simulate dealing two pairs, one card face up, and one card face down into the two remaining columns, into the house hand;

the display displaying the two remaining columns of the house hand;

the gaming computer running the software to simulate dealing two pairs of face up cards into the two remaining columns, into the player hand;

the player again selecting a second column to discard from the player hand and the house hand on the gaming computer;

the gaming computer running the software to simulate discarding the same second column from the player hand and the house hand;

the display displaying the player hand and the house hand after discarding the same second column from the player hand and the house hand;

the gaming computer running the software to simulate dealing a pair into the remaining column of the house hand;

the display displaying the house hand;

the gaming computer running the software to simulate dealing a pair into the remaining column to the player hand;

the display displaying the player hand and the house hand;

the gaming computer running the software to simulate scoring the hand; and the display displaying the score.

2. The game of claim 1, wherein the cards are crazy-stud poker cards.

3. The game of claim 1 wherein the game is played on a video gambling machine.

4. The game of claim 1, further including;

if the player wins a number N hands before the house wins a number M hands, the gaming computer declaring the player as a winner; and if the player does not win a number N hands before the house wins a number M hands, the gaming computer declaring the house as a winner.

5. The game of claim 4, wherein N is 5 and M is 3.

6. The game of claim 4, wherein N is 5 and M is 4.

7. The game of claim 4, wherein N is 4 and M is 3.

8. The game of claim 4, wherein the player selects the numbers N and M at the beginning of the game on the gaming computer.

9. The game of claim 1, wherein deck is a 52 playing card poker deck including eight cards with indicia of extra value printed on said cards.

10. The game of claim 9, wherein the indicia of extra value comprises:

indicia on the aces of spades and clubs that the aces of spades and clubs may be played as any black card;

indicia on the aces of hearts and diamonds that the aces of hearts and diamonds may be played as any red card; and indicia on deuces of clubs, spades, diamonds and hearts that the deuces may be used to fill any two pair.

11. The game of claim 1, wherein the gaming computer is a hand held gaming computer allowing the player to select a playing level.

12. The game of claim 11, wherein the player can select:

an amateur level requiring the player to win five hands before the house wins six hands to win the game;

an average level requiring the player to win five hands before the house wins five hands to win the game;

a good player level requiring the player to win five hands before the house wins four hands to win the games;

a very good player level requiring the player to win four hands before the house wins three hands to win the game; and a best player level requiring the player to win three hands before the house wins two hands to win the game.

13. A competitive solitaire game comprising the steps of:

providing gaming computer including:

a processor and memory storing software; and providing a display electrically connected to the computer;

the gaming computer running the software to simulate dealing pairs of cards from deck into a house hand comprising three columns, one card from the poker deck face up, and one card from the poker deck face down, for the house, eight cards of the deck including indicia of extra value, the indicia comprising:

indicia on two black cards that the two black cards may be played as any black card;

indicia on two red cards that the two red cards may be played as any red card; and indicia on four additional cards that the four additional cards may be used to fill any two pair;

the display displaying the house hand;

the gaming computer running the software to simulate dealing pairs of face up cards from the poker deck into a player hand comprising three columns for the player;

the player selecting a first column to discard from both hands on the gaming computer;

the gaming computer running the software to simulate discarding the same first column from both hands;

the display displaying the player hand and the house hand after discarding the same first column from both hands;

the gaming computer running the software to simulate dealing two pairs, one card from the poker deck face up, and one card from the poker deck face down into the two remaining columns, for the house;

the gaming computer running the software to simulate dealing two pairs of face up cards from the poker deck into the two remaining columns, for the player;

the display displaying the cards after discarding the same second column from the player hand and the house hand;

the player selecting a second column to discard from both hands on the gaming computer;

the gaming computer running the software to simulate discarding the same second column from both hands;

the display displaying the player hand and the house hand after discarding the same second column from the player hand and the house hand;

the gaming computer running the software to simulate dealing a pair of cards from the poker deck into the remaining column to the house hand;

the display displaying the house hand;

the gaming computer running the software to simulate dealing a pair of cards from the poker deck into the remaining column to the player hand;

the display displaying the player hand;

the gaming computer running the software to simulate scoring the hand;

the display displaying the score.

14. A competitive solitaire game comprising the steps of:

providing a video gambling game comprising:

a gaming computer including:

a processor and memory storing software; and a display electrically connected to the computer;

dealing pairs of cards of a poker deck into a house hand comprising into three columns, one card from the poker deck face up, and one card from the poker deck face down, for the house by a video gambling game, the poker deck including indicia of extra value on eight cards, the indicia comprising:

indicia on the aces of spades and clubs that the aces of spades and clubs may be played as any black card;

indicia on the aces of hearts and diamonds that the aces of hearts and diamonds may be played as any red card; and indicia on deuces of clubs, spades, diamonds and hearts that the deuces may be used to fill any two pair;

dealing pairs of face up cards from the poker deck into a player hand comprising three columns for the player by the video gambling game;

displaying the player hand and the house hand;

the player selecting a first column to discard from both hands on the video gambling game;

discarding the same first column from the player hand and the house hand on the video gambling game;

displaying the player hand and the house hand;

dealing two pairs, one card from the poker deck face up, and one card from the poker deck face down into the two remaining columns, into the house hand by the video gambling game;

dealing two pairs of face up cards from the poker deck into the two remaining columns, into the player hand by the video gambling game;

the player selecting a second column to discard from the player hand and the house hand on the video gambling game;

discarding the same second column from the player hand and the house hand on the video gambling game;

displaying the player hand and the house hand;

dealing a pair of cards from the poker deck into the remaining column to the house hand by the video gambling game;

dealing a pair of cards from the poker deck into the remaining column to the player hand by the video gambling game;

scoring the player hand and the house hand by the video gambling game; and if the player wins a number N hands before the house wins a number M hands, declaring the player as a winner by the video gambling machine;

if the player does not win a number N hands before the house wins a number M hands, declaring the house as a winner by the video gambling machine; and displaying the winner on the display.

* * * * *